United States Patent [19]

Klose et al.

[11] 4,100,630

[45] Jul. 18, 1978

[54] RECLINING FURNITURE

[76] Inventors: Odo Klose, Am Freudenberg 19, D-5600 Wuppertal 1; Alfred von Schuckmann, Nordstrasse 32 a, D-5657 Haan, both of Fed. Rep. of Germany

[21] Appl. No.: 761,457

[22] Filed: Jan. 21, 1977

[30] Foreign Application Priority Data

Jan. 24, 1976 [DE] Fed. Rep. of Germany ..... 2602638
Oct. 29, 1976 [DE] Fed. Rep. of Germany ..... 2649460

[51] Int. Cl.[2] ..... A47C 3/32; A61G 7/10
[52] U.S. Cl. ..... 5/66; 3/68
[58] Field of Search ..... 5/66–68

[56] References Cited

U.S. PATENT DOCUMENTS

| | | | |
|---|---|---|---|
| 1,701,588 | 2/1929 | Muller | 5/68 |
| 3,253,285 | 5/1966 | Fox | 5/67 |
| 3,283,342 | 11/1966 | Pankert | 5/66 |
| 3,353,193 | 11/1967 | Greiner | 5/66 |

*Primary Examiner*—Casmir A. Nunberg
*Attorney, Agent, or Firm*—Martin A. Farber

[57] ABSTRACT

A reclining furniture having rest surfaces formed in at least two parts, having rest surface sections hingedly connected with one another, and arranged adjustable in inclination to achieve a seating position of such type that the gore disposed in the range of the hinge axis is lowered during the raising of one of the rest surface sections. The border frame of the reclining furniture has opposite inner surfaces on which two opposite mountings are arranged which support the raiseable rest surface section such that the pivot axle of the raiseable rest surface section, which is mounted under the latter and spaced by a distance from the gore is mounted on a lever, the latter being arranged in pendulum manner at a second axle, and at least the pendulum movement of the lever is blockable.

17 Claims, 11 Drawing Figures

B1
B2
X
X
38
33
34
42
40
41
6
9
36
35
33'
32
37'
37
32'
7
10
31
6'
39

RECLINING FURNITURE

The present invention relates to reclining furniture with rest surfaces formed in at least two parts, the rest surface sections of which are pivotally connected with one another, and arranged adjustable in inclination to achieve a seating position of such type that the gore disposed in the range of the hinge axle lowers during the raising of one of the rest surface sections.

Mulit-part rest or reclining surfaces which are pivotally connected to one another have already been realized on hospital beds (cf. German Gebrauchsmuster Gbm 6 902 981, U.S. Pat. No. 3,191,196). Its adjustment requires an unproportionally high apparatus expense. The setting means moreover produces too large a construction height and practically occupies the entire range of the bed frame; in other cases it reduces the under floor range of such beds, which for cleaning purposes in general should remain as free as possible.

For example by German Pat. No. 1 429 255 a reclining furniture unit is known in which the lying or rest surfaces are formed in three parts, thus comprising a liftable rest surface section forming the backrest, a center rest surface section and a rest surface section forming the foot part. From the middle part there extends a support leading to the bed frame extending thereunder. The support engages on the rest surface side pivotally spaced from the pivot axis between the foot part and the center part. A force accumulator for the adjustment acts on the liftable rest surface section spaced from the pivot point between the backrest part and the center part. The accumulator is disposed in the vicinity under this rest surface section. By lifting of the same the rest surface section which forms the seat surface is lowered in the range of the gore.

It is an object and task of the present invention, particularly, that is additionally to that which may be gathered from the specification and claims, to transfer these known effects with special construction forms of beds to reclining furniture, thus to construct reclining furniture in a simpler manufacturing, use-advantageous handleable construction such that the application of the adjusting means is possible as a simple side mounting inside of a normal border frame height of the furniture and such that this means as a closed construction unit can be set up any time in the manner of subsequent equipping also by a layman.

In accordance with another object of the present invention, the above-mentioned object is aided in its solution in the manner that the liftable rest surface section is carried by two opposite mountings arranged on the inner surfaces of the border frames of the reclining furniture such that the pivot axle (e.g., 8) of the rest surface section (e.g., I) which is mounted under this rest surface section and spaced by a distance ($x$) from the gore (e.g., 11) is mounted on a lever (e.g., 10), the latter being arranged pendulum-like about a second axle (e.g., 9), and at least the pendulum movement of the lever is able to be blocked.

An advantageous manner of construction is achieved in accordance with the present invention by a suspension or hanging arrangement of the lever.

Furthermore it is advantageous in accordance with the present invention when the lever and a support arm, the latter being mounted rotatably about the lever, and supporting the raiseable rest surface section, are provided with curved slots through which a brake cheek - carrier pin extends.

It is advantageous in accordance with the present invention that the two brake cheek - carrier pins of the mountings which lie opposite one another are connected by a rod.

According to the present invention a construction form, which above all is safe in use, is achieved by a latch which blocks the pendulum movement.

It is further advantageous in accordance with the present invention if the latch is arranged on the pivot axle of the support arm.

Beyond that the invention proposes a release device simultaneously releasing the brake cheeks and latch.

Further it is advantageous in accordance with the invention that the coupling rod leading from a hand lever of the release device to the actuating wing of the brake cheek is provided with a control cam liftingly disengaging the spring mounted latch.

As a result of such design, reclining furniture is produced, the rest surfaces of which may be transformed "in no time" in a comfortable seating position with greatest consideration of the anatomical proportions of the user. The corresponding means are very simple in their construction and easily coordinatable. They can be applied conveniently inside a normal border frame height. A conversion or re-equipping is thus possible at any time. The pivot axle of the liftable rest surface section, which pivot axle lies spaced from the gore, causes the lowering movement of the hinged thereon rest surface section forming the seat surface. In order to maintain the necessary free flow movement for this, the pivot axle is amounted on a lever, which lever is arranged pendulum-like about a second axle. The latter is arranged suspended or hanging and forms a mounting unit together with the support arm, which support arm leads to the liftable rest surface section. This mounting unit is connected by means of a rod with the opposite equally formed side mounting in a manner facilitating the securing or locking and increasing the stability. The lever and arm are extended over or beyond the range of the pivot axle of the liftable rest surface section. The blocking means which fixes the inclination position prevailing under the circumstances acts on these sections. An advantageous construction form is provided in the manner that both the lever and the support arm which is mounted rotatably on the lever, are formed with curved slots, and a brake cheek -carrier pin is inserted in the slots. Here also rotatable brake cheeks can be used. The latter are mounted advantageously on a threaded section so that upon turning, the two sections are brought into a fricton-tight position. The slots can be dimensioned from the outset sufficiently wide that the swinging movements which occur on different radii do not cause a functional disturbance. A second rod can engage the lever axle of both mountings. Beside a friction tight - braking, for the extreme positions, additionally a positive form-lock without friction or slipping can be used, and indeed by means of a latch which blocks the pendulum movement of the lever. The latch is mounted on the pivot axle of the support arm and grips over a stationary or fixed catch pin. Regardless of this the intermediate positions can be fixed by the brake cheeks. As soon as the latch is lifted out, the brake cheeks can be drawn tight without the latch again falling into its catch locking position. An advantageous form of construction with respect to this is realized in a manner that the coupling rod which leads from a hand lever of the release device to the actuation wing of the brake jaw possesses a control cam liftingly disengaging the spring biased latch.

Furthermore in order to ensure that the border frame of the furniture remains most extensively free of loading during the brake actuation, that is, the position of the frame members are not changed, and moreover to achieve a direct coordination of the actuating means, it is proposed in improvement and furtherance of the subject matter of the present invention to arrange the brake cheeks on both sides of the lever and to clamp the lever therebetween.

An advantageous form of construction of the invention is attained by a cam control of the outer brake cheek.

Moreover according to the invention it is advantageous that a carrier pin having two control cam - pressure transmitting pieces is arranged in a spacer tube.

Further advantageously in accordance with the present invention is that the respective outer-most disposed brake cheek is complementarily or form-fittingly placed in a non-round opening of the fastening base plate.

Further the invention proposes that the control curve-inclination extends on the diagonals of the outer brake cheek.

Furthermore advantageous in accordance with the present invention, the curved slots have a kidney-shape or cashew-shape.

The application or engagement of the brake locking means exclusively on the lever of the adjusting mounting means holds the fastening base plate without load. In accordance with stability, still this only requires to be designed with a consideration of the normally occurring stresses. In practice this means that it can be designed smaller and with a thin wall.

The actuation handle can be connected without indirect manner with the brake blocking device. The use of a simple cam control thereby is permitted. The latter is realized and operative on the outer brake cheek.

An advantageous construction, above all is provided by a carrier pin having two control cam - pressure transmitting pieces, with the carrier pin arranged in a spacer tube.

The spacer tube forms the abutment support for both of the inner brake cheeks.

The front edges of the pressure transmitting pieces are designed corresponding to the control cam of the outer brake cheek. By turning the carrier pin as a central actuating means, the corresponding control cams are lifted from one another, which leads to an axial movement of the outer brake cheeks, and which axial movement causes the braking action.

The outer brake cheeks are each disposed in an opening of the fastening base plate. They can move therein free of obstruction. These outer lying brake cheeks as well as the openings are designed to have a nonround shape, preferably with four edges or as a square, in order to provide the necessary guarantee against rotation. The inclination of the control cam and control surfaces, respectively, of the brake cheeks extend in the diagonals of these four-edged cheeks.

The curved slot in the support arm is kidney-shaped.

In every phase of the course of the tipping-movement of the raiseable, reclining or rest surface section, there continuously is a larger surface brake cheek - engagement or application.

With the above and other objects and advantages in view, the present invention will become more clearly understood in connection with the following detailed description of a preferred embodiment thereof when considered with the accompanying drawings, of which:

Figure 1:
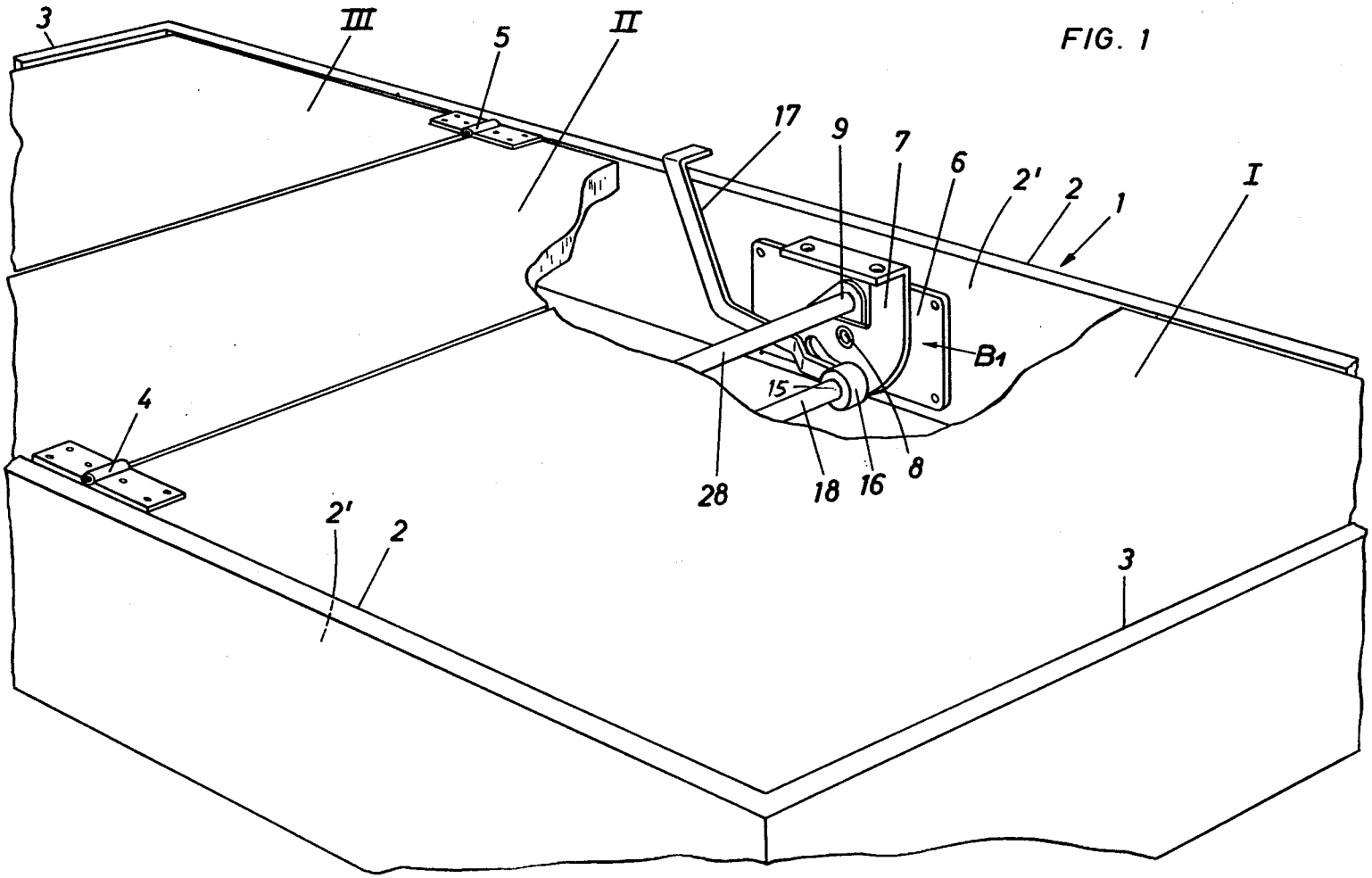
FIG. 1 is a perspective view of a first embodiment of the reclining furniture in accordance with the present invention with a planar lying surface partially broken away.

Referring now to the drawings, the reclining furniture of both embodiments has a border frame 1 comprising two edge-wise arranged longitudinal border or edge members 2 and two likewise edge-wise arranged transverse edge members 3 extending parallel to each other.

The lying surface of this furniture unit is formed in three sections. They comprise a liftable lying surface section I, a center lying surface section II, and a further lying surface section III.

The entire lying surface easily springs back with respect to the upper edge and the inner surface of the border frame 1. The reclining surface sections are of various lengths in consideration of the anatomical proportions of the person who is to use the unit. The lying surface section I forming the backrest of the furniture in raised position has the largest length. The lying surface sections are illustrated in the form of plates or panels. Instead naturally these can also be frame sections which are preferably completed or filled with resilient support elements, such as spring cores or interiors, or the like.

The individual lying surface sections are pivotably connected to one another. The articulation points are designated with the numerals 4 and 5, respectively.

Figure 6:
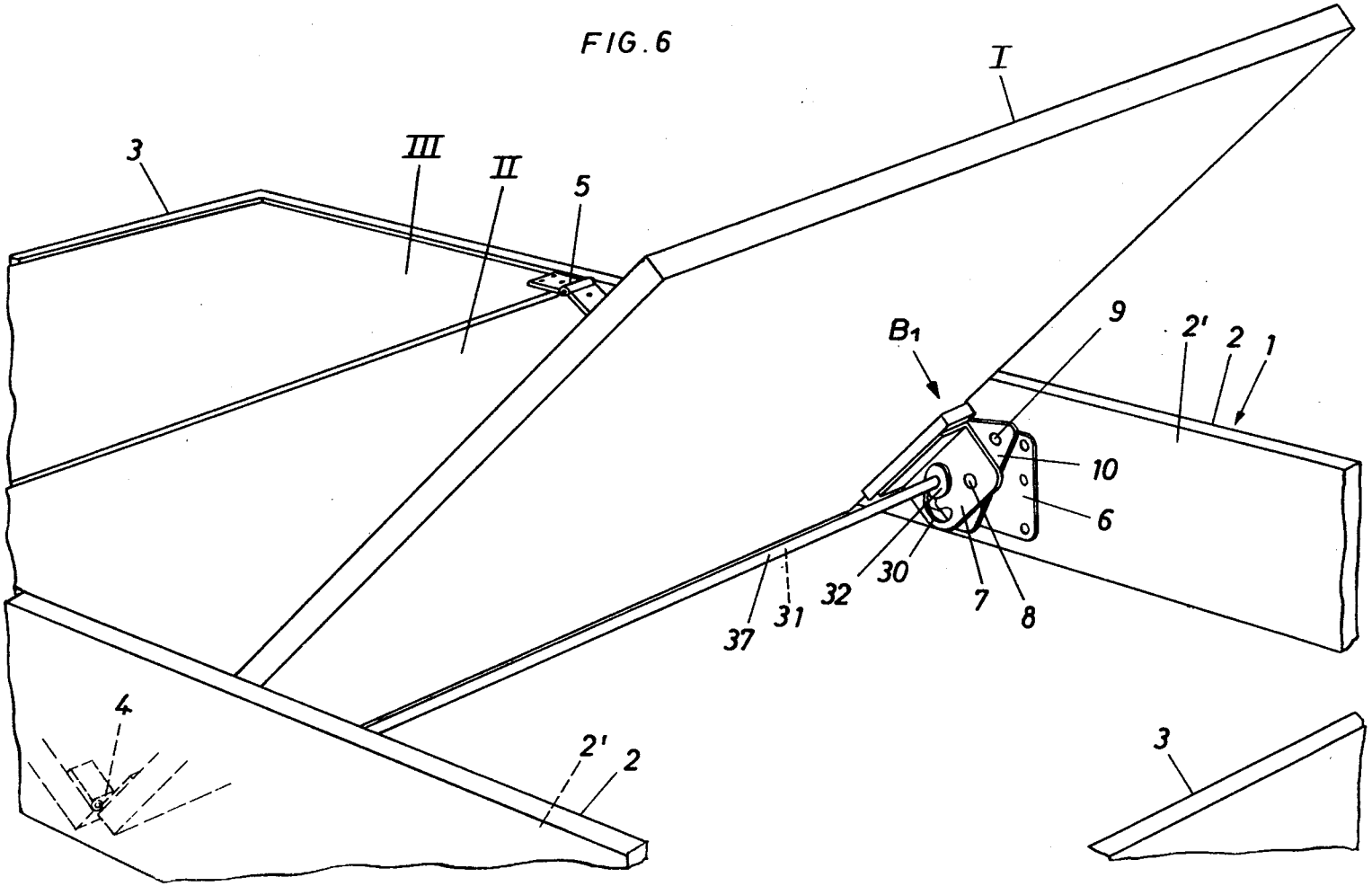
FIG. 6 is a perspective view of the reclining chair according to a second embodiment with raised lying surface section forming the backrest and backrest-sided lowered seat.

The lying or reclining surface section III which forms the foot part is fixed in the position which is evident from FIGS. 1 and 6 so that its edge which borders or joins on the center reclining surface section II forms a rigid or fixed pivot point.

The liftable reclining surface section I is carried or supported by two mountings B1 and B2 which are arranged opposite one another on the inner surfaces 2' of the edge frame members. The mountings comprise a fastening base plate 6 of a height smaller than that of the height of the edge frame members. A support or carrier cam 7 guides to each fastening base plate 6. The support arm 7 is directly or indirectly connected with the reclining surface section I which forms the backrest. The support arm is for this purpose upwardly angled-off in a frame inward direction and provided with passage openings for the fastening elements. At half the height of the support arms 7 there is mounted the pivot axle 8 of the lying surface section I which makes possible the lifting and high pivoting, respectively, of this lying surface section I. The pivot axle 8 is mounted on a swinging arm or lever 10, the latter being pendulum-like or pivotably mounted about a second axle 9.

Figure 3:
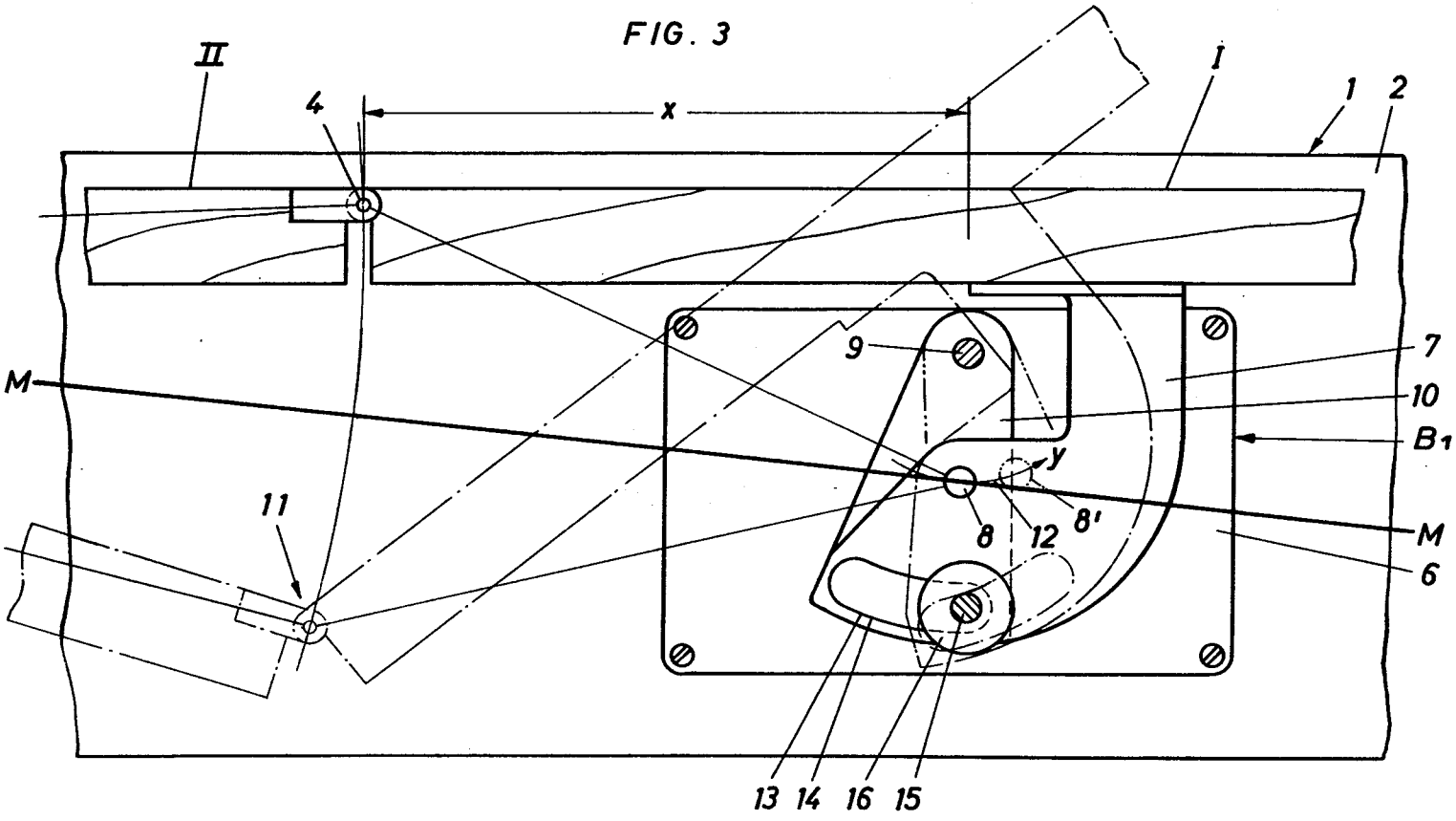
FIG. 3 is a side elevational view illustrating a movement sketch of the mounting.
Figure 5:
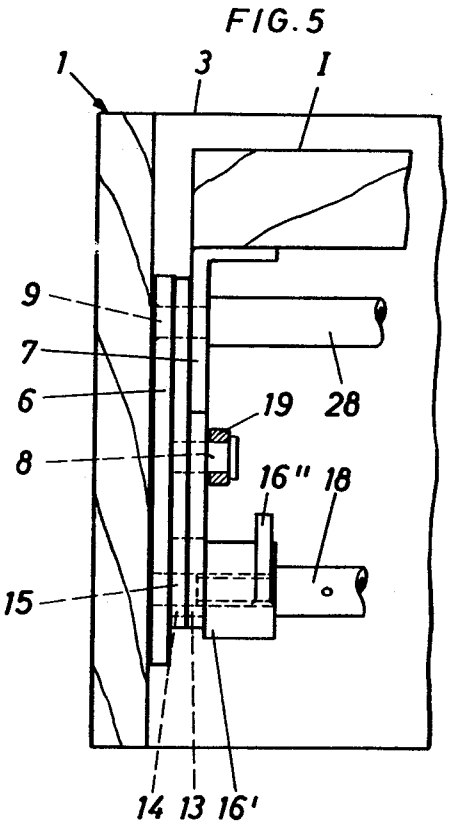
FIG. 5 is a partial sectional view taken along the line V—V.
Figure 4:
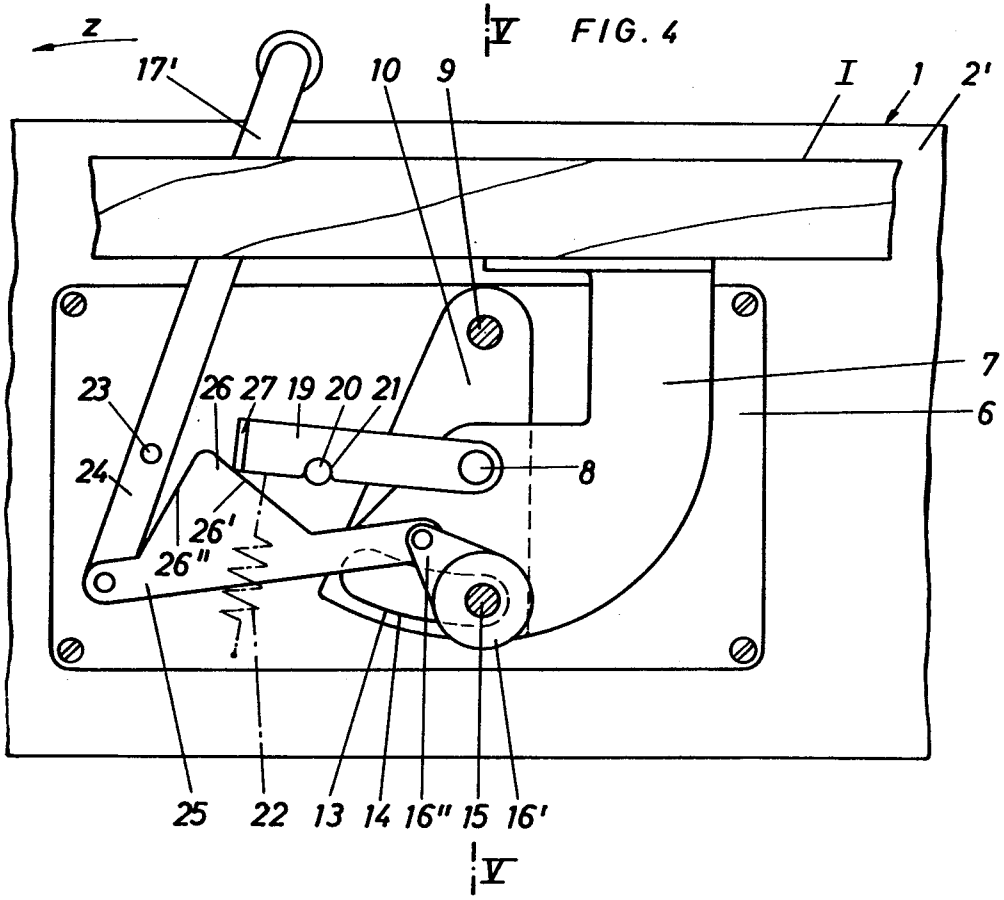
FIG. 4 is a side elevational view of the mounting showing the release device.
Figure 7:
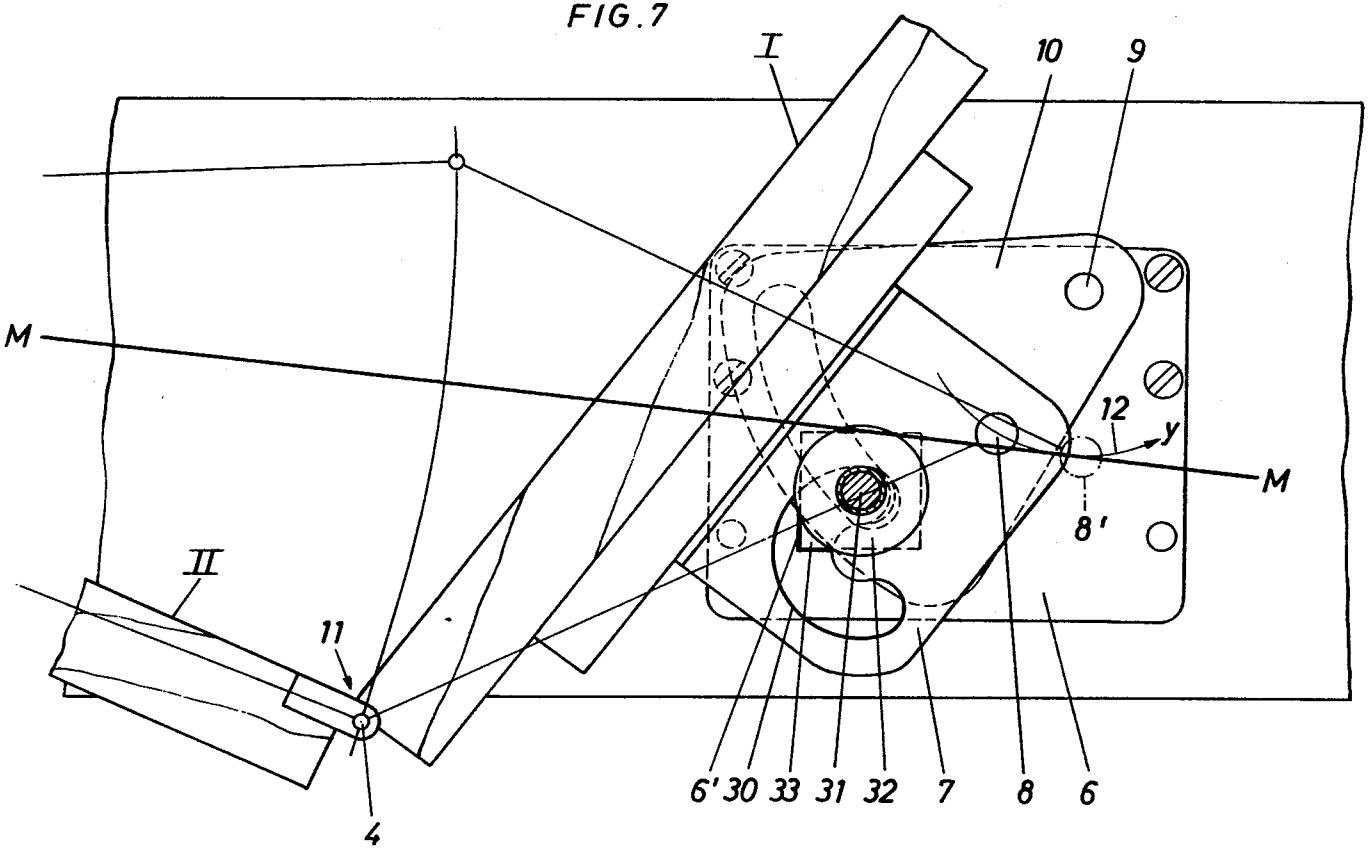
FIG. 7 is an elevational view of the mounting in detailed illustration in one position according to FIG. 6.

The pivot axle 8 is disposed spaced by a distance x from a gore 11 (seat-opening angle), noting for example FIG. 3. Taking into consideration the kinematic movement courses during the lifting movement of the lying surface section I which forms the backrest and with the resulting lowering movement of the center reclining surface section II forming the seat following along with this, the pivot axle 8 performs a withdrawing movement to a new position in the direction of the arrow y of the trajectory 12 which is seen in FIGS. 3 and 7. One utility end position of the pivot axle 8 is designated with the numeral 8' (FIGS. 3 and 7).

In both end positions, the reclining or lying surface sections I and II (hereinafter called "rest surface sections") which are pivotably connected with one another occupy the same toggle joint - buckling or bend position relative to the substantially constant center line M—M, the latter crossing the pivot points which are involved. According to the embodiment of FIG. 3, this leads to the condition that in both extreme end positions, the swinging arm or lever 10 assumes the same base position. The line M—M intersects the pivot points 5 and 8, which line is passed over by the pivot point 4.

The swinging arm or lever 10 according to the first embodiment (FIGS. 1-5) is arranged suspended, the lever 10 having a relatively narrow sector. The lever 10 and the carrier arm 7 of the raiseable rest surface section I in downwardly extended sections are provided with uniformly arched, curved slots 13 and 14. These curved slots take into account or allow for the spacial requirements of the pivot movement. Since the lever 10 and the support arm 7 swing overlyingly or superimposingly with respect to one another with different radii, the width of the curved slots are selected such that a brake cheek-carrier pin 15 which passes through the curved slots 12, 13 does not prevent the swinging movement. The brake cheek-carrier pins 15 are secured in the fastening base plate 6. The end section of the pins can be provided with a threading so that a brake jaw or cheek 16 having a corresponding inner thread upon turning by means of a hand lever 17 blocks or locks the lever 10 and carrier arm 7 with respect to each other whereby the stepless or continuously adjustable seat position is fixed or held.

Figure 2:
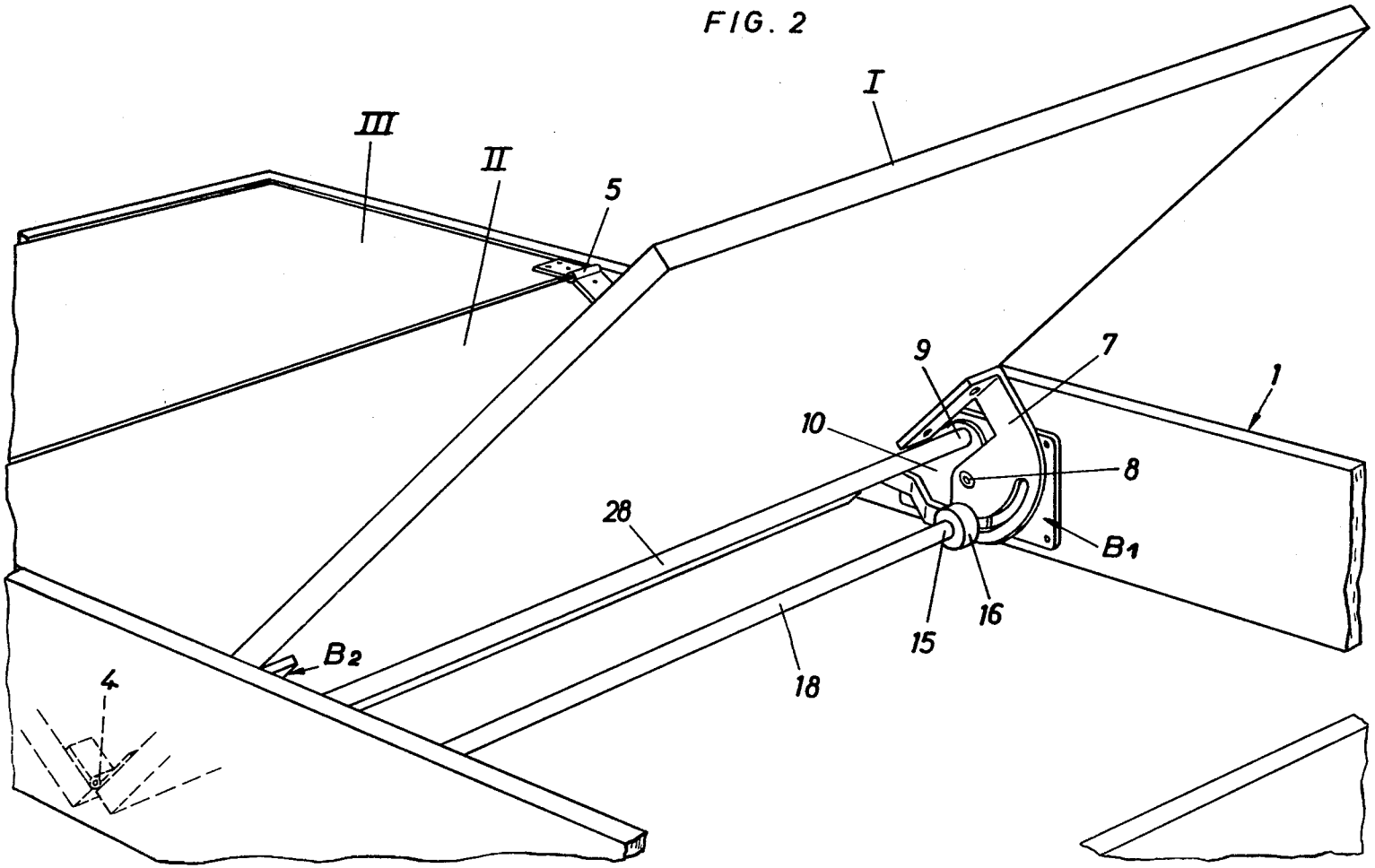
FIG. 2 is a perspective view of the reclining furniture according to FIG. 1 with raised lying surface section forming the backrest and backrest-sided lowered seating surface.

As may be seen from FIG. 1, the brake cheek-carrier pin 15 which is visable there by the broken-away rest surface is connected with the brake cheek-carrier pin (which is not further illustrated) of the opposite mount B2 over a rod 18 (compare also FIG. 2).

Instead of blocking or locking of the lever 10 and consequently the carrier arm 7 attained by friction-tight action, here additionally there is provided a latch 19 (compare FIG. 4) which fixes the end positions, blocking or locking thus also the pendulum-movement of the lever 10. This latch is mounted on the corresponding advanced out pivot axle 8 of the support arm 7. It is formed of a flat material and is inwardly angled-off or bent at the end side. On its lower edge it is formed with a catch recess 21 which cooperates with a catch pin 20, the latter extending from the fastening base plate 6. The latch can act as a drop latch as a result of its one-arm formation or rather in the closing direction it can be held by means of spring action or biasing. The corresponding spring is illustrated in dot-dash lines and is indicated by the reference numeral 22. A release or disengaging device simultaneously releasing the brake cheek and latch is coordinated to the embodiment according to FIG. 4. This release device comprises a hand lever 17'. The lever 17' is pivotably mounted at pivot point 23 on the fastening base plate 6. Its actuating section 24 which extends beyond this pivot point drives a substantially horizontally lying coupling rod 25, which in turn pivotally engages and acts on an actuating wing 16'' of the brake cheek 16'. By swinging the hand lever 17' in the direction of the arrow *z* the brake position is lifted. Following along as a result of this action, a control cam 26 formed seated on the coupling rod lifts the latch 19 from out of its catch locking position. The control cam 26 in this manner steps against the angled-off section 27 of the latch 19.

The control cam is formed on both sides with ramp inclinations 26' and 26'' so that a stepping-over or cooperative camming against the angled-off portion 27 of the latch 19 is possible from both directions. The latch 19 with its lower edge rides during displacement of the lever 10 on the catch pin 20.

The second axle 9 also is connected with the corresponding axle of the opposite mounting B2 via a bar 28.

Figure 8:
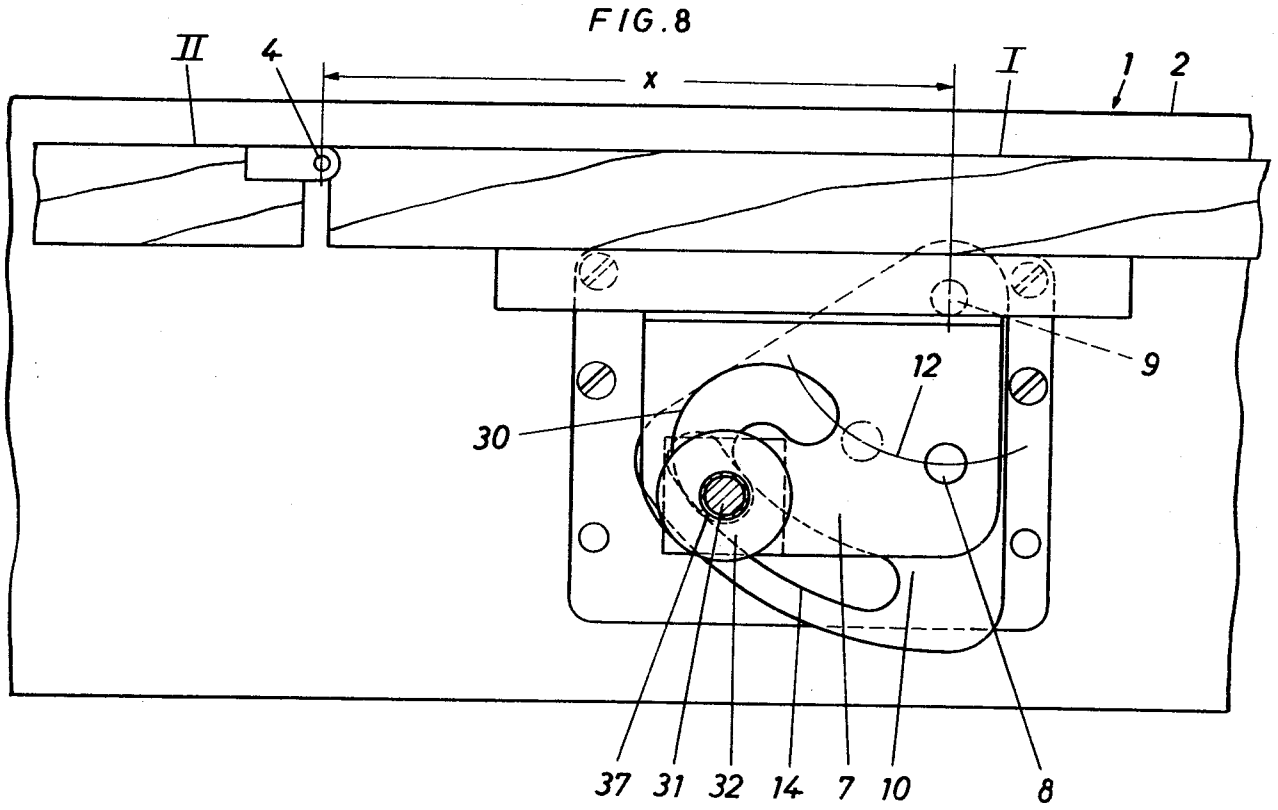
FIG. 8 is an elevational view of the above mounting with a planar lying surface.
Figures 9, 10, 11:
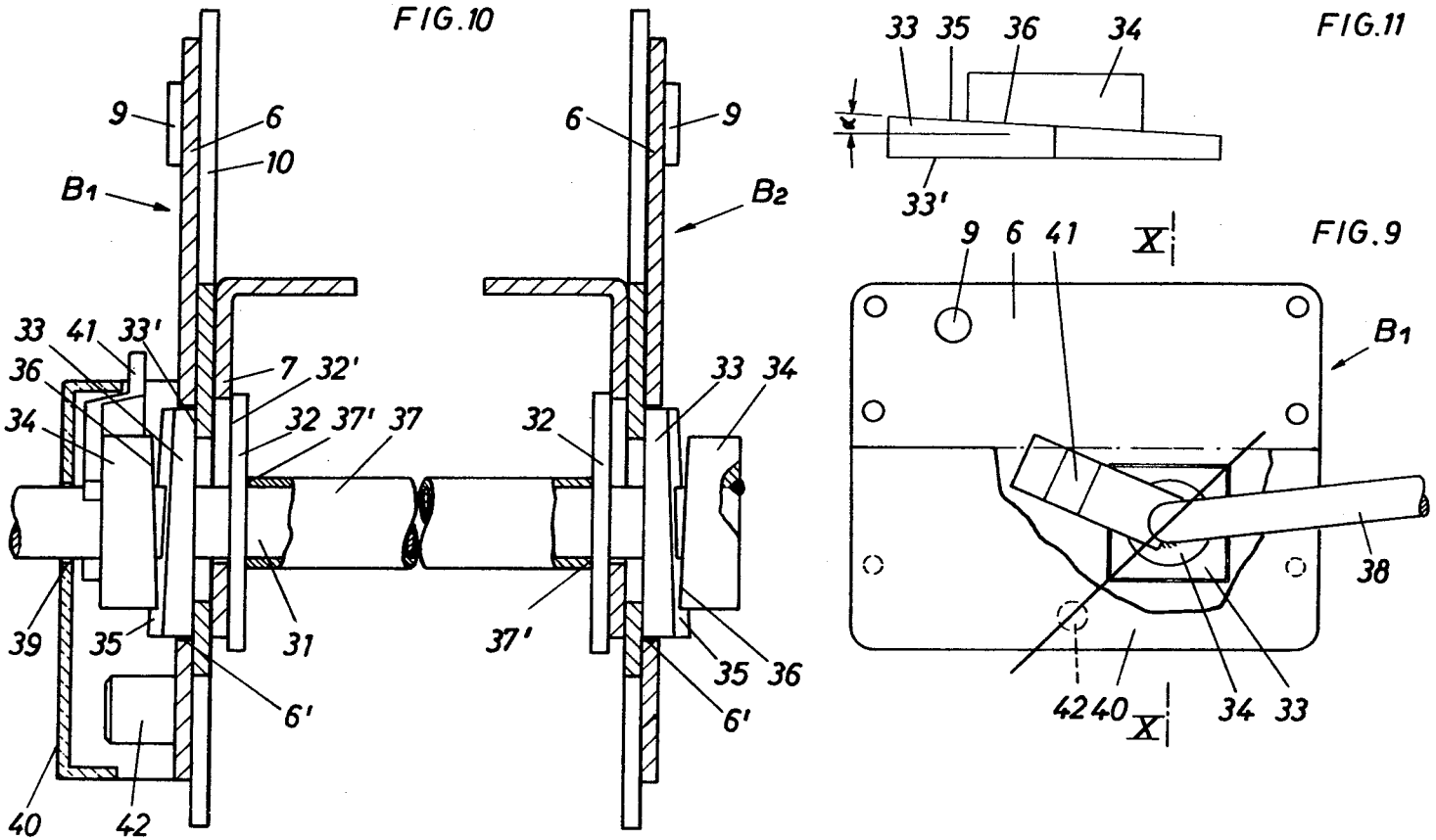
FIG. 9 is an elevational view, partially broken away, of an outside view of the mounting illustrating the actuating handle for the brake-locking device.
FIG. 10 is a section taken along the lines X—X in FIG. 9, and indeed in a substantially natural or actual scale, however partially broken away.
FIG. 11 is an elevational view showing the outer brake cheek with associated control cam-thrust member illustrating the inclination causing the axial displacement of the brake cheek, and in the release position.

The lever 10 according to the second embodiment example of FIGS. 6-11 has a larger sectorial section and likewise is arranged suspended. The lever 10 and the support arm 7 of the liftable rest surface section I furthermore are formed with arcuate slots 14, 30 of different curvature characteristic one under the other. The curved slot 14 which is only slightly curved lies in the downwardly extended section of the segment-formed lever 10. The curved slot 30 which points downwardly toward the right with its slot ends and which has a highly curved kidney-shaped form or semi-circular form, respectively, lies in that half of the support arm 7 which points to the gore or hinge 11, the support arm 7 having a substantially rectangular plan. The longer rectangular edges extend in the planar lying position, which in FIG. 8 is present in the horizontal.

A stationary carrier pin 31 is set through the slots 14 and 30. The carrier pin 31 extends from mounting to mounting and forms the single traverse connecting these mountings with one another. It lies substantially at the height of the pivot axle 8, and indeed on the side of the gore and is the carrier of at least one inner brake cheek 32 and one outer brake cheek 33. The latter with their clamping surfaces 32' and 33' which point toward one another step against the lever 10, and indeed by engaging together the carrier arm 7, thus exclusively against the pivotal moveably mounted construction parts of the mounting. The carrier pin 31 which passes through the cheeks 32 and 33 is provided outside of the fastening base plates with one control or radial cam-thrust transmitting member 34 each. The latter are fixed thereon by welding or the like and cooperate with a control cam - inclination or bevel 35 of the opposite outer brake cheeks 33. The inclination angle alpha amounts to approximately four degrees. The inclination axis lies in the diagonals D-D of the brake cheeks 33 which have a four edge or square plan or peripheral shape. The front surface 36 of the pressure transmitting member 34, which front face 36 cooperates with this inclination, is correspondingly inclined, so that by twisting or turning of one of these surfaces, here the pressure transmitting member 34 which is rigidly connected with the carrier pin 31 displaces the outer brake cheek in the direction of the stationary brake cheek 32, and in this manner the downwardly longer extended section of the lever 10 is clamped tight so that a swinging movement of the same about the second axle 9 is prevented. In this manner the support arm 7 is also prevented from a pivotal movement about the pin 8. Also in order to avoid small residual swinging movements of both of the support arms which under circumstances are possible on the basis of the tolerances of the slots, the arms are, as already suggested, equally fixable or lockable. The position of the rest surface section I which is respectively assumed from time to time maintained positively and with surety. The stationary inner brake cheeks 32 are supported by the spacer tube 37 surrounding the carrier pin 31. Both front ends 37' thereof form an abutment. The actuation of the brake blocking means takes place over a direct outwardly going actuation handle in the form of a pivot lever 38 which is connected with the carrier pin or is constructed integrally therewith. This carrier pin is inserted at one end through an opening 39 of a protection cover 40. The pivot lever is provided with a limit stop wing 41. In its range of movement there projects an abutment stop pin 42 which projects from the fastening base plate 6. The pin 42 is mounted on the lower range of the edge of the fastening base plate 6. The plane of inclination of the outer brake cheek, abutment or limit stop finger or wing 41 and pivot lever 38 are spacially arranged such that the actuation arm pivot lever 38 automatically falls from its brake-release position by its overweight or unbalance into the brake-initial setting position and brake blocking or locking position, respectively, that is the actuation handle can not be brought over the upper turning point.

The control cam-pressure transmitting pieces 34 are somewhat smaller in their diameter than the edge lengths of the outer brake cheeks 33, the latter having the four edge plan or peripheral shape. The openings in the fastening base plate 6 which mount the brake cheeks are designated with the numeral 6'. They are adjusted complementary to the peripheral contour of the brake cheeks and thus form a guarantee against rotation or prevents the rotation thereof as well as a free continuous or longitudinal displaceability therethrough with a brake actuation. In this manner every loading of the securing base plate 6 which results from this is excluded or kept away. The entire mounting installation is practically only suspended on the axle pin 9 and is supported additionally in advantageous manner by the brake blocking or locking means.

We claim:

1. Reclining furniture having rest surfaces formed in at least two parts, defining rest surface sections hingedly connected with one another, and arranged adjustable in inclination to achieve a seating position such that a gore disposed in the range of a hinge axis is lowered during the raising of a raiseable of the rest surface sections, comprising a border frame of the reclining furniture having opposite inner surfaces, two mounting means arranged opposite one another on said opposite inner surfaces of the frame for supporting the raiseable rest surface section and each of said mounting means including a pivot axle means including a pivot axle for operatively pivotally mounting the raiseable rest surface section, said pivot axle being spaced from the gore and disposed under the raiseable rest surface section, a second axle, a lever mounted in pendulum manner on said second axle, said pivot axle being mounted on said lever, means for blocking at least the pendulum movement of said lever.

2. The reclining furniture as set forth in claim 1, wherein said lever is arranged hanging on said second axle.

3. The reclining furniture as set forth in claim 1, wherein said pivot axle means comprises a support arm pivotally mounted on said lever via said pivot axle, the raiseable rest surface section is secured to said support arm, said lever and said support arm are formed with curved slots, and a brake cheek-carrier pin of each of said mounting means extends through the curved slots.

4. The reclining furniture as set forth in claim 3, further comprising a common rod connected to each of said brake cheek - carrier pins of the two opposite arranged mounting means.

5. The reclining furniture as set forth in claim 1, further including a latch means for blocking the pendulum movement of said lever.

6. The reclining furniture as set forth in claim 5, wherein said pivot axle means comprises a support arm pivotally mounted on said lever on said pivot axle, and said latch means is mounted on said pivot axle.

7. The reclining furniture as set forth in claim 5, wherein said blocking means includes a brake cheek and said latch means, and release means for simultaneously releasing said brake cheek and said latch means.

8. Reclining furniture having rest surfaces formed in at least two parts, defining rest surface sections hingedly connected with one another, and arranged adjustable in inclination to achieve a seating position such that a gore disposed in the range of a hinge axis is lowered during the raising of a raiseable of the rest surface sections, comprising a border frame of the reclining furniture having opposite inner surfaces, two mounting means arranged opposite one another on said opposite inner surfaces of the frame for supporting the raiseable rest surface section and each including a pivot axle means including a pivot axle for operatively pivotally mounting the raiseable rest surface section, said pivot axle being spaced from the gore and disposed under the raiseable rest surface section, a second axle, a lever mounted in pendulum manner on said second axle, said pivot axle being mounted on said lever, means for blocking at least the pendulum movement of said lever, a latch means for blocking the pendulum movement of said lever, said blocking means includes a brake cheek and said latch means, release means for simultaneously releasing said brake cheek and said latch means, said release means includes a hand lever, means for spring biasing said latch means, said brake cheek is formed with an actuation wing, a coupling rod operatively connected to said hand lever and to said actuation wing and includes a control cam means for liftingly unlocking the spring biased latch means.

9. The reclining furniture as set forth in claim 1, wherein said blocking means includes brake cheeks arranged on both sides of said lever, said brake cheeks operatively clamping said lever therebetween.

10. The reclining furniture according to claim 9, wherein one of said brake cheeks constitutes an outer brake cheek, and said blocking means further includes cam control means for operatively cooperating with said outer brake cheek.

11. Reclining furniture having rest surfaces formed in at least two parts, defining rest surface sections hingedly connected with one another, and arranged adjustable in inclination to achieve a seating position such that a gore disposed in the range of a hinge axis is lowered during the raising of a raiseable of the rest surface sections, comprising a border frame of the reclining furniture having opposite inner surfaces, two mounting means arranged opposite one another on said opposite inner surfaces of the frame for supporting the raiseable rest surface section and each including a pivot axle means including a pivot axle for operatively pivotally mounting the raiseable rest surface section, said pivot axle being spaced from the gore and disposed under the raiseable rest surface section, a second axle, a lever mounted in pendulum manner on said second axle, said pivot axle being mounted on said lever, means for blocking at least the pendulum movement of said lever, said blocking means includes brake cheeks arranged on both sides of said lever, said brake cheeks operatively clamping said lever therebetween, a carrier pin extending through said brake cheeks of each of said mounting means, two control cam - pressure transmitting members mounted on said carrier pin, and a spacer tube between said brake cheeks of each of said mounting means, respectively, and said carrier pin extends through said spacer tube.

12. Reclining furniture having rest surfaces formed in at least two parts, defining rest surface sections hingedly connected with one another, and arranged adjustable in inclination to achieve a seating position such that a gore disposed in the range of a hinge axis is lowered during the raising of a raiseable of the rest surface sections, comprising a border frame of the reclining furniture having opposite inner surfaces, two mounting means arranged opposite one another on said opposite inner surfaces of the frame for supporting the raiseable rest surface section and each including a pivot axle means including a pivot axle for operatively pivotally mounting the raiseable rest surface section, said pivot axle being spaced from the gore and disposed under the raiseable rest surface section, a second axle, a lever mounted in pendulum manner on said second axle, said pivot axle being mounted on said lever, means for blocking at least the pendulum movement of said lever, said blocking means includes brake cheeks arranged on both sides of said lever, said brake cheeks operatively clamping said lever therebetween, one of said brake cheeks constitutes an outer brake cheek, and said blocking means further includes cam control means for operatively cooperating with said outer brake cheek, said mounting means includes a fastening base plate secured to said inner surface of the border frame and having a non-round opening, said outer brake cheek is formed complementary to said opening and is positioned therein.

13. The reclining furniture as set forth in claim 11, wherein one of said brake cheeks of each of said mounting means constitutes an outer brake cheek having a four edge shape and said control cam - pressure transmitting members are formed with an inclination extending on a diagonal of said outer brake cheeks, respectively.

14. Reclining furniture having rest surfaces formed in at least two parts, defining rest surface sections hingedly connected with one another, and arranged adjustable in inclination to achieve a seating position such that a gore disposed in the range of a hinge axis is lowered during the raising of a raiseable of the rest surface sections, comprising a border frame of the reclining furniture having opposite inner surfaces, two mounting means arranged opposite one another on said opposite inner surfaces of the frame for supporting the raiseable rest surface section and each including a pivot axle means including a pivot axle for operatively pivotally mounting the raiseable rest surface section, said pivot axle being spaced from the gore and disposed under the raiseable rest surface section, a second axle, a lever mounted in pendulum manner on said second axle, said pivot axle being mounted on said lever, means for blocking at least the pendulum movement of said lever, said blocking means includes brake cheeks arranged on both sides of said lever, said brake cheeks operatively clamping said lever therebetween, said pivot axle means comprises a support arm connected to the raiseable rest surface section and pivotally mounted relative to said lever on said pivot axle, and said support arm is formed with a kidney-shaped curved slot.

15. The reclining furniture as set forth in claim 1, wherein said second axle is operatively secured to said frame.

16. The reclining furniture as set forth in claim 15, wherein said pivot axle is moveable relative to the frame and constitutes the sole operative pivot connection of said raiseable rest surface section to the frame.

17. The reclining furniture as set forth in claim 15, wherein said lever is formed with an opening complementary to said second axle, the latter extends in said opening, and said lever is pivotally mounted on said second axle with said opening non-displaceable relative to said second axle.

* * * * *